US009774976B1

(12) United States Patent
Baumgarte

(10) Patent No.: US 9,774,976 B1
(45) Date of Patent: Sep. 26, 2017

(54) ENCODING AND RENDERING A PIECE OF SOUND PROGRAM CONTENT WITH BEAMFORMING DATA

(71) Applicant: Apple Inc., Cupertino, CA (US)

(72) Inventor: Frank M. Baumgarte, Sunnyvale, CA (US)

(73) Assignee: APPLE INC., Cupertino, CA (US)

( * ) Notice: Subject to any disclaimer, the term of this patent is extended or adjusted under 35 U.S.C. 154(b) by 133 days.

(21) Appl. No.: 14/498,021

(22) Filed: Sep. 26, 2014

Related U.S. Application Data

(60) Provisional application No. 61/994,725, filed on May 16, 2014.

(51) Int. Cl.
*H04R 5/00* (2006.01)
*H04S 5/00* (2006.01)
*H04S 7/00* (2006.01)

(52) U.S. Cl.
CPC ..... *H04S 5/00* (2013.01); *H04S 7/302* (2013.01); *H04S 7/305* (2013.01)

(58) Field of Classification Search
CPC ... H04S 5/00; H04S 7/30; H04S 7/302; H04S 7/303; H04S 7/304; H04S 7/305; H04S 1/007; H04S 2400/03; H04S 2400/11; H04S 2400/15; H04S 2420/03; H04S 2420/11; H04S 3/00; H04S 3/008; H04S 2420/01; H04S 1/002; H04S 7/00; H04S 7/301;

(Continued)

(56) References Cited

U.S. PATENT DOCUMENTS 7,489,788 B2 2/2009 Leung et al.
8,103,006 B2 1/2012 McGrath
2012/0051568 A1* 3/2012 Kim ..... H04R 1/403 381/307

(Continued)

FOREIGN PATENT DOCUMENTS

WO WO-2014/046916 A1 3/2014

OTHER PUBLICATIONS

Baumgarte, Frank, et al., "Binaural Cue Coding—Part I: Psychoacoustic Fundamentals and Design Principles", *IEEE Transactions on Speech and Audio Processing*, vol. 11, No. 6, Nov. 2003, pp. 509-519.
Faller, Christof, et al., "Binaural Cue Coding—Part II: Schemes and Applications", *IEEE Transactions on Speech and Audio Processing*, vol. 11, No. 6, Nov. 2003, pp. 520-531.

(Continued)

*Primary Examiner* — Leshui Zhang
(74) *Attorney, Agent, or Firm* — Blakely, Sokoloff, Taylor & Zafman LLP

(57) ABSTRACT

A system and method for rendering a piece of sound program content to include data and parameters that describe perceptual, acoustic, and geometric object properties is provided. The perceptual, acoustic, and geometric properties may include one or more of 1) a three-dimensional location of an audio object, 2) a width of an audio object, 3) ambience characteristics of an audio object, 4) diffuseness characteristics of an audio object, and 5) a direct-to-reverberant sound ratio of an audio object. Based on these pieces of data, an audio playback system may produce one or more beam patterns that reproduce three-dimensional properties of audio objects and/or audio channels of the piece of sound program content. Accordingly, the system and method for rendering a piece of sound program content may accurately represent the multi-dimensional properties of the piece of sound program content through the use of beam patterns.

24 Claims, 15 Drawing Sheets

(58) Field of Classification Search

CPC ..... H04S 5/005; G10L 19/008; G10L 19/22; G10L 19/24; H04R 5/04; H04R 27/00; H04R 2227/003; H04R 5/02; H04R 5/023; H04R 29/00; H04R 29/001; H04R 29/002; H04R 29/003; H04R 1/02; H04R 1/025; H04R 1/028; H04R 2201/023; H04R 2499/11; H04R 2499/15; H04R 2205/021; H04R 2420/07; H04M 3/56; H04M 1/72572; H04M 3/53366; H04M 9/085

USPC ..... 381/300–311, 77, 80, 82, 85, 86, 111, 381/116, 117, 119, 61, 63, 59, 332–336, 381/33, 17–23, 66; 700/94; 455/566; 345/173

See application file for complete search history.

(56) References Cited

U.S. PATENT DOCUMENTS

| | | | | |
|---|---|---|---|---|
| 2012/0288126 | A1* | 11/2012 | Karkkainen ..... | H04R 3/005 381/309 |
| 2013/0223658 | A1* | 8/2013 | Betlehem ..... | H04S 3/002 381/307 |
| 2013/0322666 | A1 | 12/2013 | Yoo et al. | |
| 2014/0023197 | A1* | 1/2014 | Xiang ..... | H04S 1/007 381/17 |

OTHER PUBLICATIONS

Kolundzija, Mihailo, et al., "Design of a Compact Cylindrical Loudspeaker Array for Spatial Sound Reproduction", *Audio Engineering Society, Convention paper 8336*, Presented at the 130th Convention, May 13-16, 2011, London, UK, 10 pages.

* cited by examiner

ENCODING AND RENDERING A PIECE OF SOUND PROGRAM CONTENT WITH BEAMFORMING DATA

RELATED MATTERS

This application claims the benefit of the earlier filing date of U.S. provisional application No. 61/994,725, filed May 16, 2014.

FIELD

A system and method for rendering a piece of sound program content, which includes data and parameters that describe perceptual, acoustic, and geometric object properties is provided. These properties may be used by a playback or rendering system to produce one or more audio beam patterns for the piece of sound program content. Other embodiments are also described.

BACKGROUND

Audio coding standards such as MPEG-Surround and Spatial Audio Object Coding (SAOC) use a perceptual parameterization of the spatial image to reduce the bit rate for transmission and storage. For example, in MPEG-Surround a multi-channel audio signal can be encoded as a downmix signal along with a set of spatial parameters. The spatial parameters describe auditory spatial cues of time-frequency tiles of the audio signal. With the spatial parameters, the image can be reconstructed by restoring the original auditory spatial cues when converting the downmix up to the multi-channel signal at the decoder. The spatial cues determine the perceived location and width of the perceived image for each time-frequency tile.

Similarly, in SAOC independent audio objects are encoded as a downmix signal along with parameters that describe for each time-frequency tile which object is most active. The decoder can then render the objects at different locations by generating the corresponding auditory spatial cues in the multi-channel upmix.

Although the systems above apply measures to represent spatial cues, these systems do not address three-dimensional audio reproduction. Accordingly, these traditional systems may not effectively represent the distance (depth) and height of sound sources.

The approaches described in this section are approaches that could be pursued, but not necessarily approaches that have been previously conceived or pursued. Therefore, unless otherwise indicated, it should not be assumed that any of the approaches described in this section qualify as prior art merely by virtue of their inclusion in this section.

SUMMARY

A system and method for rendering a piece of sound program content to include data and parameters that describe acoustic and geometric object properties is provided. These properties may be used by a playback system to produce one or more audio beam patterns for the piece of sound program content. In one embodiment, an encoded bitstream, which represents/contains a piece of sound program content, may include a downmix signal, a set of spatial parameters, and/or beamforming metadata. In one embodiment, the beamforming metadata may include one or more of 1) a three-dimensional location of an audio object, 2) a width of an audio object, 3) ambience characteristics of an audio object, 4) diffuseness characteristics of an audio object, and 5) a direct-to-reverberant sound ratio of an audio object.

The bitstream may be transmitted or otherwise transferred to an audio playback system. The audio playback system may extract the downmix signal, the spatial parameters, and the beamforming metadata. Based on these extracted pieces of data, the audio playback system may produce one or more beam patterns that reproduce three-dimensional properties of audio objects and/or audio channels of the piece of sound program content. In one embodiment, the direction and size of the beam(s) relative to room surfaces and listener location may be used to create or enhance a spatial image of the auditory scene. This technique may achieve spatial rendering with a smaller number of loudspeaker units than traditional techniques with a high degree of envelopment and "beyond" loudspeaker localization. For instance, if there are two loudspeaker units, the spatial image would not be limited to locations close to a virtual straight line that connects the two loudspeaker units.

The above summary does not include an exhaustive list of all aspects of the present invention. It is contemplated that the invention includes all systems and methods that can be practiced from all suitable combinations of the various aspects summarized above, as well as those disclosed in the Detailed Description below and particularly pointed out in the claims filed with the application. Such combinations have particular advantages not specifically recited in the above summary.

BRIEF DESCRIPTION OF THE DRAWINGS

The embodiments of the invention are illustrated by way of example and not by way of limitation in the figures of the accompanying drawings in which like references indicate similar elements. It should be noted that references to "an" or "one" embodiment of the invention in this disclosure are not necessarily to the same embodiment, and they mean at least one.

DETAILED DESCRIPTION

Several embodiments are described with reference to the appended drawings are now explained. While numerous details are set forth, it is understood that some embodiments of the invention may be practiced without these details. In other instances, well-known circuits, structures, and techniques have not been shown in detail so as not to obscure the understanding of this description.

Figure 1A:
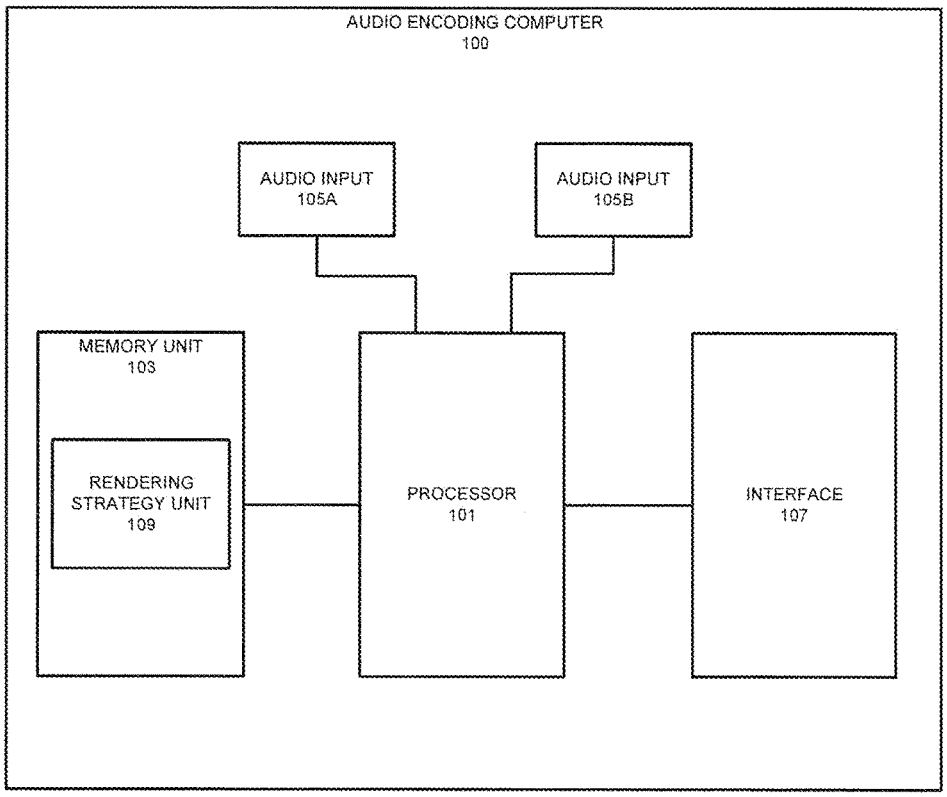
FIG. 1A shows a component diagram of an audio encoding computer according to one embodiment.

FIG. 1 shows a component diagram of an example audio encoding computer 100 according to one embodiment. The audio encoding computer 100 may be any device that is capable of encoding sound program content. The encoded sound program content may be thereafter transmitted or otherwise distributed/delivered to a consumer through one or more separate mediums as will be described in greater detail below. The audio encoding computer 100 may be a desktop computer, a laptop computer, a tablet computer, or any other similar computing device that is capable of decoding audio and playing the decoded audio back through a set of speakers.

As shown in FIG. 1, the audio encoding computer 100 may include a hardware processor 101 and/or a memory unit 103. The processor 101 and the memory unit 103 are generically used here to refer to any suitable combination of programmable data processing components and data storage that conduct the operations needed to implement the various functions and operations of the audio encoding computer 100. The processor 101 may be an applications processor typically found in a smart phone, while the memory unit 103 may refer to microelectronic, non-volatile random access memory. An operating system may be stored in the memory unit 103 along with application programs specific to the various functions of the audio encoding computer 100, which are to be run or executed by the processor 101 to perform the various functions of the audio encoding computer 100. For example, a rendering strategy unit 109 may be stored in the memory unit 103. As will be described in greater detail below, the rendering strategy unit 109 may be used to encode one or more pieces of sound program content. For instance, in a binaural reproduction system, such as headphones or cross-talk-canceled stereo loudspeakers, the rendering strategy unit 109 may encode a downmix signal with spatial cues using head-related transfer functions (HRTFs). However, when using loudspeakers or loudspeaker arrays, spatial rendering can be enhanced by taking advantage of different directivity patterns and/or beamforming. The direction and size of the beam(s) relative to the room surfaces and listener location may be used to create or enhance a spatial image of the auditory scene. This technique may achieve spatial rendering with a smaller number of loudspeaker units than traditional techniques with a high degree of envelopment and "beyond" loudspeaker localization. For instance, if there are two loudspeaker units, the spatial image would not be limited to locations close to a virtual straight line that connects the two loudspeaker units.

In one embodiment, the audio encoding computer 100 may include one or more audio inputs 105 for receiving audio signals from external and/or remote devices. For example, the audio encoding computer 100 may receive audio signals from a remote server. The audio signals may represent one or more channels of a piece of sound program content (e.g., a musical composition or an audio track for a movie). For example, a single signal corresponding to a single channel of a piece of multichannel sound program content may be received by an input 105 of the audio encoding computer 100. In another example, a single signal may correspond to multiple channels of a piece of sound program content, which are multiplexed onto the single signal.

In one embodiment, the audio encoding computer 100 may include a digital audio input 105A that receives digital audio signals from an external device and/or a remote device. For example, the audio input 105A may be a TOSLINK connector or a digital wireless interface (e.g., a wireless local area network (WLAN) adapter or a Bluetooth receiver). In one embodiment, the audio encoding computer 100 may include an analog audio input 105B that receives analog audio signals from an external device. For example, the audio input 105B may be a binding post, a Fahnestock clip, or a phono plug that is designed to receive a wire or conduit and a corresponding analog signal from an external device.

Although described as receiving pieces of sound program content from an external or remote source, in some embodiments pieces of sound program content may be stored locally on the audio encoding computer 100. For example, one or more pieces of sound program content may be stored within the memory unit 103. As described in greater detail below, the pieces of sound program content retrieved locally or via the audio inputs 105 may be encoded to take advantage of spatial relationships of audio channels and/or objects and different directivity patterns.

In one embodiment, the audio encoding computer 100 may include an interface 107 for communicating with other devices. For example, the interface 107 may be used for transmitting encoded sound program content to a device of a consumer (e.g., a mobile device such as a smart phone, a set-top box, a gaming device, a personal electronic device, a laptop computer, a tablet computer, or a desktop computer). In other embodiments, the interface 107 may be used for transmitting encoded sound program content to a distributor (e.g., a streaming audio/video service). The interface 107 may utilize wired mediums (e.g., conduit or wire) to communicate with other devices. In another embodiment, the interface 107 may communicate with other devices through a wireless connection. For example, the network interface 107 may utilize one or more wireless protocols and standards for communicating with other devices, including the IEEE 802.11 suite of standards, cellular Global System for Mobile Communications (GSM) standards, cellular Code Division Multiple Access (CDMA) standards, Long Term Evolution (LTE) standards, and/or Bluetooth standards.

Figure 1B:
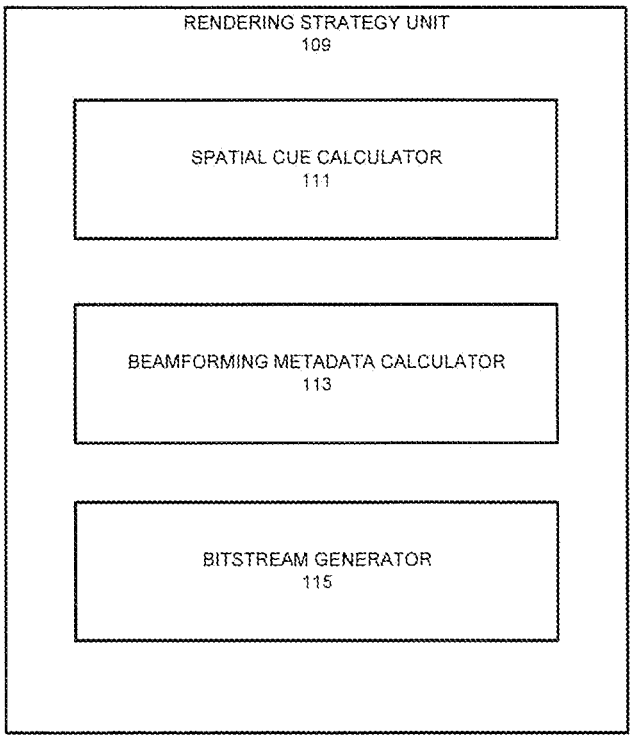
FIG. 1B shows a component diagram of a rendering strategy unit according to one embodiment.
Figure 2:
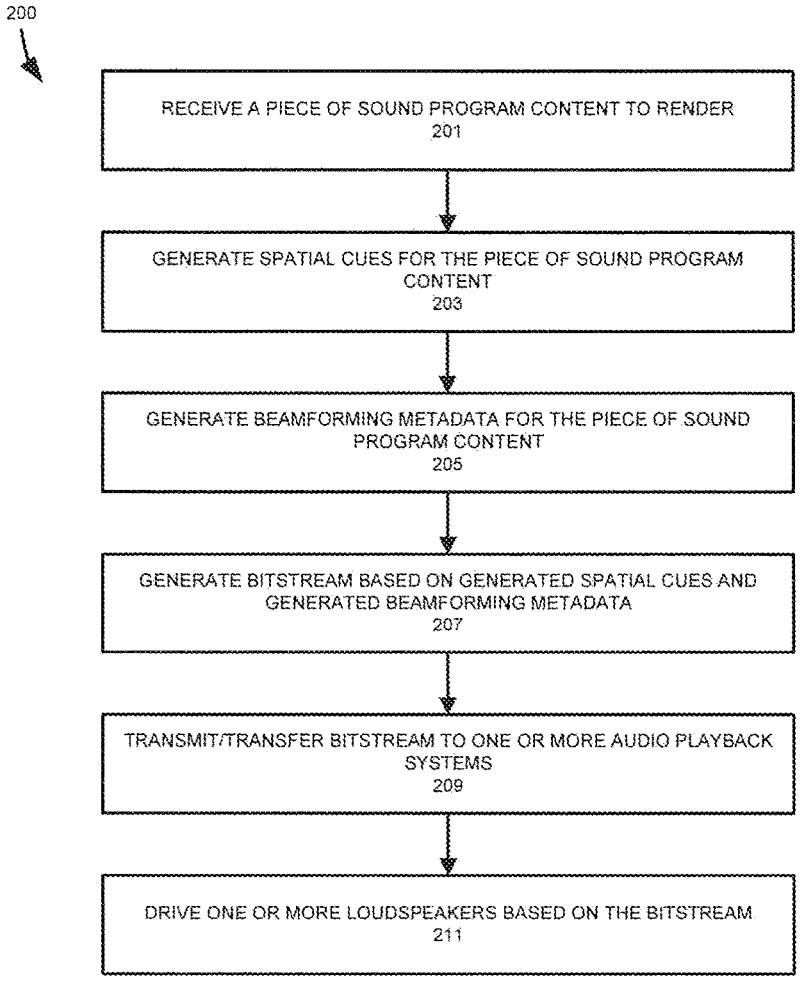
FIG. 2 shows a method for rendering a piece of sound program content according to one embodiment.

Turning now to FIG. 2, a method 200 for rendering a piece of sound program content will now be discussed. In one embodiment, each operation of the method 200 may be performed by one or more components of the audio encoding computer 100. For example, one or more of the operations of the method 200 may be performed by the rendering strategy unit 109 of the audio encoding computer 100, including the spatial cue calculator 111, the beamforming metadata calculator 113, and the bitstream generator 115 as shown in FIG. 1B. In other embodiments, one or more of the operations of the method 200 may be performed by the audio encoding computer 100 in conjunction with an audio playback device as will be described in greater detail below.

Although the operations of the method 200 are described and shown in a particular order, in other embodiments, the operations may be performed in a different order. For example, in some embodiments, two or more operations of the method 200 may be performed concurrently or during overlapping time periods.

In one embodiment, the method 200 may commence at operation 201 with receipt of a piece of sound program content to be rendered/encoded. The piece of sound program content may be received via one or more of the audio inputs 105 or retrieved locally from the audio encoding computer 100 (e.g., retrieved from the memory unit 103). In another embodiment, the piece of sound program content may be retrieved over the interface 107. The piece of sound program content may be represented by one or more signals or pieces of data that represent one or more audio objects and/or audio channels. For example, the piece of sound program content may include three streams that represent front left, front center, and front right channels of an audio scene. In other embodiments, the piece of sound program content may include multiple audio objects that represent different sound sources (e.g., different speakers/singers, sound effect sources, and/or musical instruments). The piece of sound program content may correspond to a musical composition, a track for a television show or a movie, and/or any other type of audio work.

Figure 3:
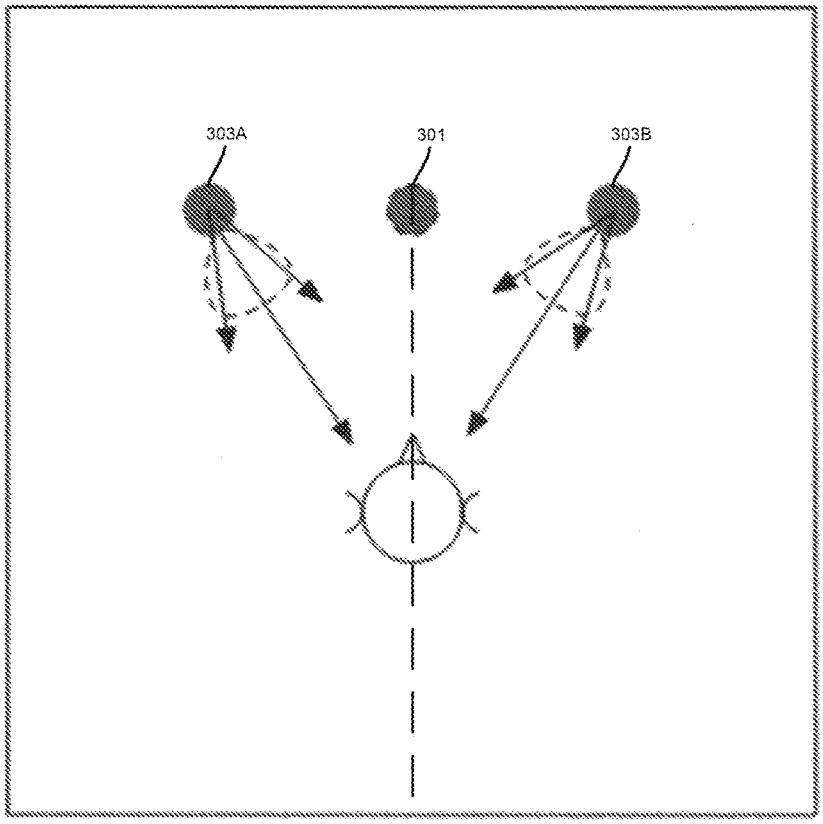
FIG. 3 shows a sound image appearing on a virtual line between loudspeakers according to one embodiment.
Figure 4:
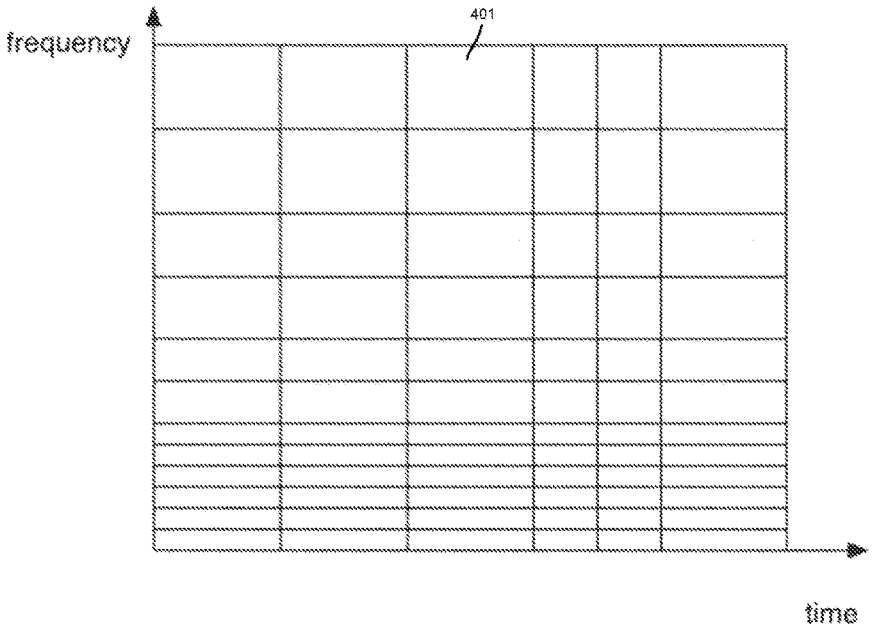
FIG. 4 shows an example set of time-frequency tiles according to one embodiment.

Following retrieval of the piece of sound program content, operation 203 may generate spatial cues for the piece of sound program content. In one embodiment, the spatial cue calculator 111 may generate spatial cues for the piece of sound program content at operation 203. These parameters are associated with binaural cues that are relevant to the perception of an audio object's location and size. For example, the spatial cues generated at operation 203 may include inter-channel level differences (ILD), time differences (ITD), and correlation (IC) differences. In one embodiment, the spatial cues may be applied to time-frequency tiles/segments of channels of the piece of sound program content such that a sound image would appear somewhere near a virtual line 301 between loudspeakers 303A and 303B as shown in FIG. 3. FIG. 4 shows an example set of time-frequency tiles 401 that may be used for generating spatial cues. The time-frequency tiles 401 may be generated for instance by a short-time Fourier transform. The time and frequency resolution may be chosen similar to the relevant psychoacoustic results for the human auditory system. Hence the low frequency range has a finer frequency resolution. The time resolution may take into account occasional fast changes of the spatial image during transient attacks in the audio signal that may benefit from a temporary increase in time resolution. In one embodiment, the spatial cues generated at operation 203 may be similar or identical to the parametric spatial audio coding provided by one or more standards, including MPEG-Surround and MPEG SAOC.

In one embodiment, the spatial cues may be generated relative to a downmix signal for the piece of sound program content. In this embodiment, operation 203 may also generate a downmix signal for the piece of sound program content. Accordingly, the spatial cues allow the piece of sound program content to be represented by a lower number of channels/signals and the original channels may be extracted by applying the spatial cues to the downmix signal by an audio playback system.

At operation 205, beamforming metadata may be generated that facilitates the production of beam patterns by an audio playback system. In one embodiment, the beamforming metadata calculator 113 may generate the beamforming metadata at operation 205. As described above, parametric spatial audio coding, such as provided by MPEG-Surround and MPEG SAOC, carry spatial parameters in the bitstream that describe the level differences, time delays, and correlation between audio channels. These parameters are associated with binaural cues that are relevant to the perception of the audio object's location and size. However, since these traditional system designs are based on standard loudspeaker setups, such as 5.1 surround, associated encoding schemes do not include parameters that take advantage of a loudspeaker system that provides beamforming. In contrast, the metadata generated at operation 205 leverages the beamforming capabilities of an audio playback system.

In one embodiment, the beamforming metadata generated at operation 205 may describe properties such as a 3D location of an audio object (i.e., azimuth, elevation, and distance data), width of an audio object (i.e., azimuth and elevation range data), ambience of an audio object, diffuseness of an audio object, direct-to-reverberant sound ratio of an audio object, and/or properties of the room acoustics for rendering. When an audio object or channel is rendered by an audio playback system, this additional metadata can be used to render an object/channel using beam patterns such that these properties are reproduced as closely as possible.

Figure 5:
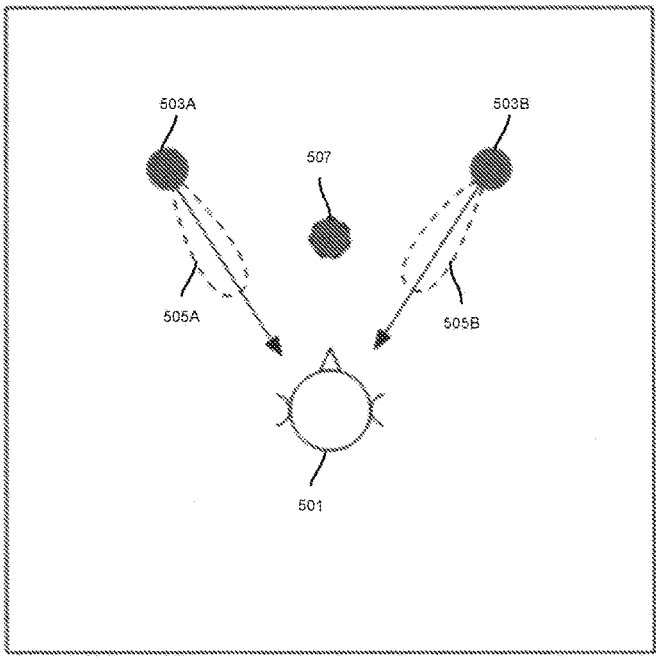
FIG. 5 shows sound beams pointed at a listener to generate a near sound image according to one embodiment.
Figure 6:
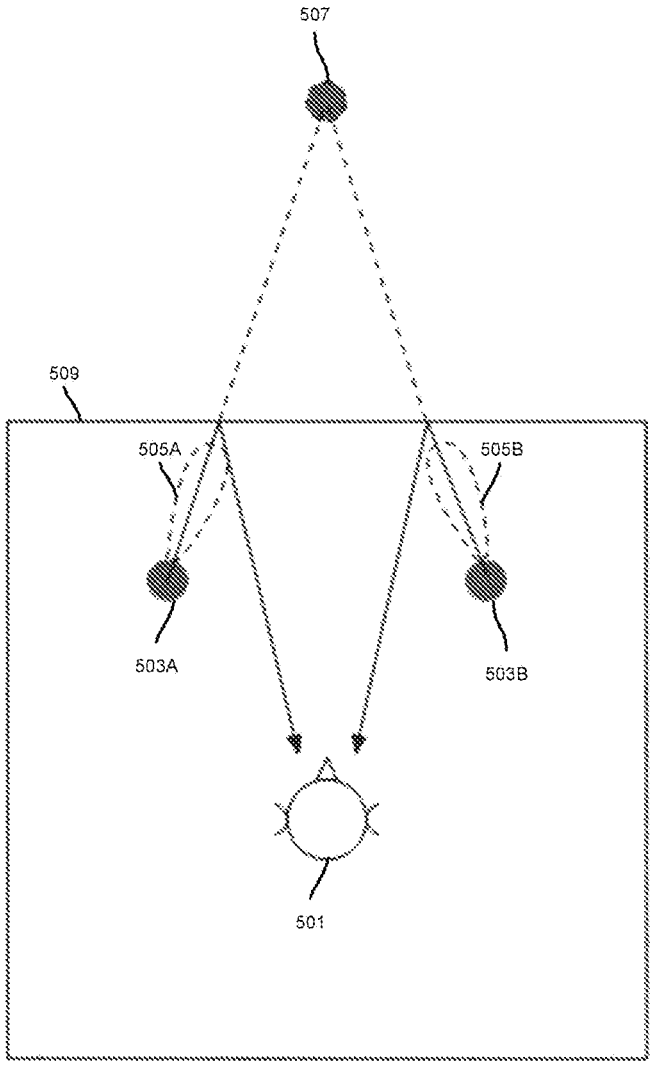
FIG. 6 shows sound beams pointed away from a listener to generate a distant sound image according to one embodiment.
Figure 7:
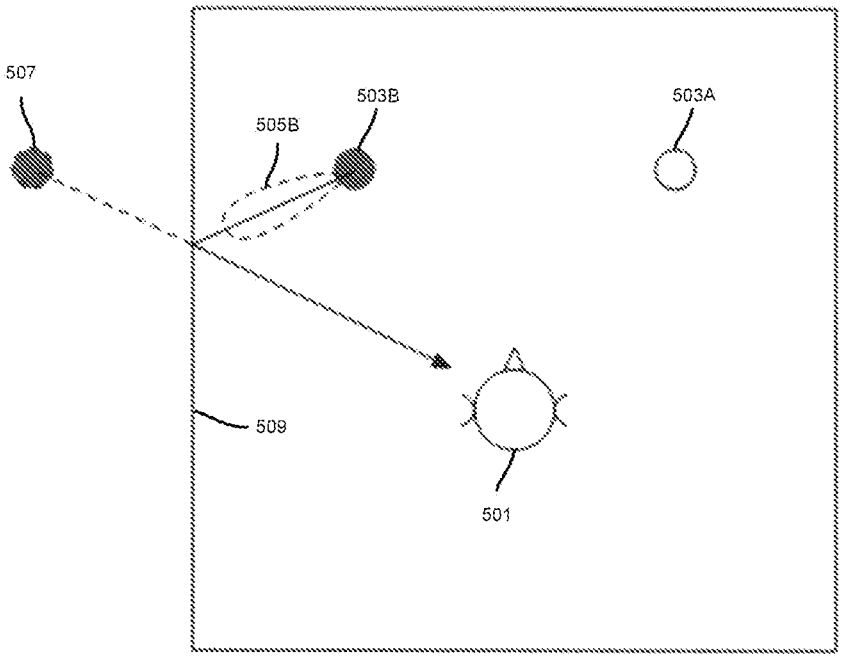
FIG. 7 shows a virtual sound that appears behind a wall according to one embodiment.
Figure 8:
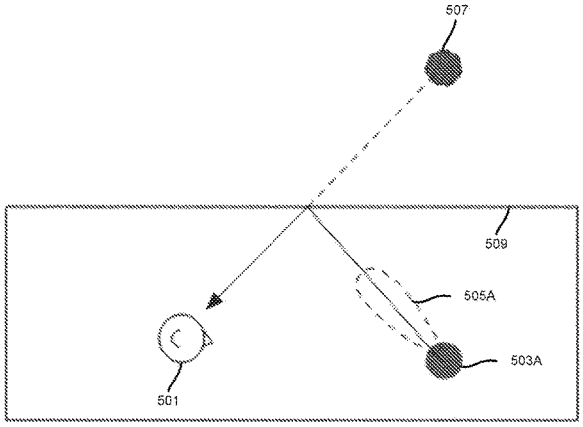
FIG. 8 shows height localization being influenced by pointing beams upwards or downwards according to one embodiment.
Figure 9:
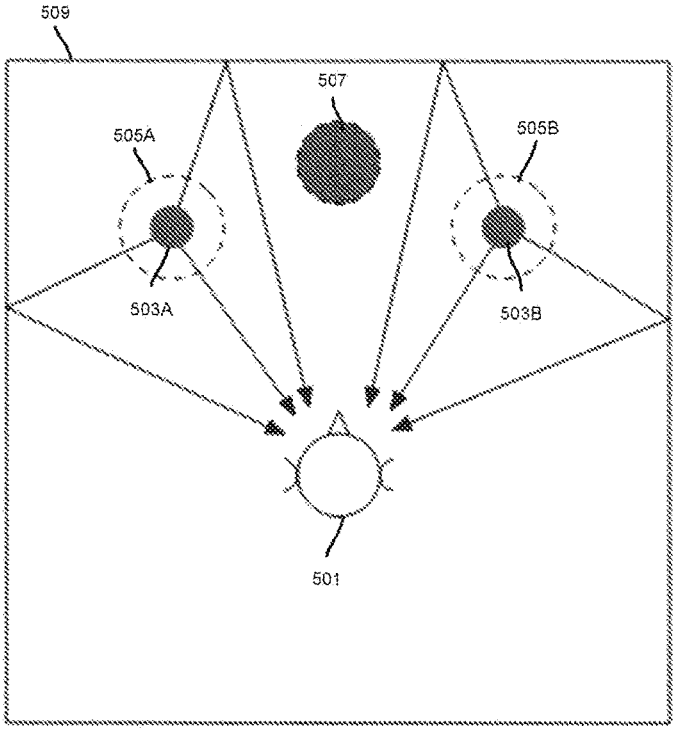
FIG. 9 shows an omnidirectional beam pattern increasing the amount of diffuse sound reflected from room boundaries and accordingly generating a larger virtual object according to one embodiment.

A few examples illustrate the effect of different beam patterns on the spatial image location when two loudspeaker units are used in a standard stereo setup. These loudspeaker units may be driven by an audio playback system that receives an encoded bitstream, which was generated by the method 200. While the examples show a system with two loudspeaker units, the scheme can be easily expanded to more units. As shown in FIG. 5, typically the loudspeaker units 503A and 503B will be located around the listener 501 in a horizontal plane, but the units 503 may also be located higher and lower when the number of loudspeaker units 503 is larger. In FIG. 5 the beam patterns 505A and 505B point toward the listener 501 to minimize wall reflections. This will induce the impression that the virtual sound object 507 is closer than with traditional loudspeakers. In contrast, if the beams 505 point away from the listener 501 as shown in FIG. 6, the virtual object 507 is perceived further away, depending on the acoustical properties and location of walls 509. It is intuitive that modifications of beam patterns 505 can be used to control how far away the virtual object 507 will appear. Similarly, a virtual object 507 can be moved to the far side by pointing the beams 505 toward a side wall 509. If the wall 509 is very reflective, the virtual sound source 507 will appear behind the wall 509 (like a mirror image in optics) as illustrated in FIG. 7. Height localization may be influenced by pointing beams 505 upwards or downwards as shown in FIG. 8. Traditionally, the image width is controlled by de-correlation. An omnidirectional pattern as shown in FIG. 9 may be used to achieve a similar effect by increasing the amount of diffuse sound reflected from room boundaries and accordingly generating a larger virtual object 507.

As described above, if an audio object has very high diffuseness and ambience, the metadata generated at operation 205 may induce a playback system to use beams 505 that point away from the listener 501 to the room boundaries (i.e., the walls 509). In contrast, if the diffuseness and ambience parameters recorded in the beamforming metadata are smaller, beams 505 are used that deliver more direct sound energy to the listener 501. In current MPEG codecs, the correlation parameter is not sufficient to achieve independent steering of beams 505 and control of inter-channel correlation.

As noted above, in one embodiment, the beamforming metadata may include 3D location and width information for audio objects. This information may be used to control the playback beams 505. For a smaller distance, the beams 505 may be pointed more towards the listener 501, while the beams 505 may point away from the listener 501 for a larger distance. Accordingly, the beams 505 will direct more energy away from the listener 501 to the walls 509, if the width is larger.

Many traditional upmixing algorithms, for instance going from stereo to 5.1 surround, are based on ambience extraction. Since there is no side information or metadata, this is a "blind" approach that involves some computational complexity and may not yield the most accurate results because objects with different ambience may overlap in time and frequency. The advantage of explicitly including metadata for ambience and related parameters is a more accurate description of each object that can lead to higher quality rendering, including for loudspeaker systems without beamforming.

In one embodiment, room acoustic parameters may be included in the beamforming metadata generated at operation 205. These room acoustic parameters may be used for rendering of an audio object in a "virtual" room. In this embodiment, the listener 501 will perceive an object in a room independent from the actual listening room in which the listener 501 is physically located. Accordingly, the virtual room may be more or less reverberant than the room in which the listener 501 is actually located. Metadata generated at operation 205 may be used to describe acoustic parameters relative to an audio object and a listener 501 location. The acoustic parameters may include a direct sound to reverberant sound ratio, absorption, size, and reflections, which can in part be modeled by room impulse responses. With the knowledge of the playback room acoustics, an audio playback system can control the beams 505 in a way to mimic the properties of the "virtual" room.

If the loudspeakers 503 are located in a horizontal plane but the audio object 507 being represented is much higher than the plane, the metadata generated at operation 205 may describe beams 505 such that some energy is directed towards the ceiling and reflected down to the listener 501 to achieve a perceived elevation as described above and shown in FIG. 8.

As in MPEG-Surround and SAOC codecs, multiple audio objects may be rendered that overlap in time and frequency. To accomplish this rendering for the examples mentioned above, the same approach of time-frequency tiling may be used (e.g., using the time-frequency tiles 401 shown in FIG. 4). For each time-frequency tile 401, beam steering and other rendering control is done according to the pre-dominant object in that tile 401 (i.e., the audio object that has the largest energy).

Although beamforming metadata generated at operation 205 may be associated with time-frequency tiles/segments 401, in other embodiments, beamforming metadata may be associated with other components of a piece of sound program content. For example, the beamforming metadata may be associated with audio objects and/or audio channels within the piece of sound program content. For instance, a background audio object in a scene may have a very large ambience that does not change over time. Such an audio object could be noise from a highway that is far away relative to foreground sound. In one embodiment, this background audio object may be associated with beamforming metadata that informs the renderer (i.e., an audio playback device) to create maximum ambience (e.g. steer the beams away from the listener 501 for this object). Accordingly, the beamforming metadata may be associated with a particular audio object or audio objects that is invariable over time. Similar associations may be made for an audio channel or audio channels or any other component of a for a piece of sound program content (e.g., a front center channel) or any other component of a piece of sound program content. Although described as time-invariant metadata, in some embodiments time-variant metadata may be generated at operation 205. In this embodiment, the beamforming metadata may vary as a function of time such that an associated beam corresponding to an object, channel, or another component of the piece of sound program content may alter over time.

Following generation of beamforming metadata at operation 205, a bitstream representing the piece of sound program content from operation 201 may be generated at operation 207. In one embodiment, the bitstream generator 115 may generate the bitstream at operation 207. The bitstream may include the spatial cues generated at operation 203 along with a corresponding downmix signal and the beamforming metadata generated at operation 205. The bitstream may be transmitted or otherwise delivered to one or more audio playback systems at operation 209.

Following receipt of the bitstream, an audio playback system may decode the bitstream and drive one or more loudspeaker units to produce sound for a listener at operation 211. For example, operation 211 may include extracting the downmix signal, the spatial cues, and the beamforming metadata from the bitstream. In one embodiment, the audio playback system may include similar components to that of the audio encoding system 100. For example, an audio playback system may include a hardware processor 101, a memory unit 103, audio inputs 105, and/or an interface 107.

Spatial rendering related to the method 200 described here is not limited to traditional loudspeaker setups in a room. Instead, the method 200 may equally apply to other scenarios such as rendering in a car or with portable devices (e.g., laptop computers, tablet computers, smart phones, and personal gaming devices) that include multiple transducers. Accordingly, the audio playback system described herein may be any device that is capable of driving multiple transducers to generate sound for a piece of sound program content.

Traditionally, multi-channel signals encoded using a method like MPEG-Surround are rendered with conventional loudspeakers by regenerating ILD, ITD, and IC of each time-frequency tile in the upmix. For rendering such a signal using loudspeaker units with variable beam patterns, the auditory spatial parameters can be translated/mapped into a new set of parameters that includes control parameters for beam patterns, such as 3D beam angle and directivity.

For instance, the auditory spatial cues may be used to estimate the perceived location and size of a virtual source. This spatial information could then be translated into a combination of auditory spatial cues generated at operation 203 and beam pattern data generated at operation 205 that are used to create approximately the same image. Due to the beam patterns, the scheme is more flexible in terms of image locations that can be rendered compared to a conventional loudspeaker system. Hence, by using variable beam patterns, the number of loudspeaker units can be reduced.

To avoid coloration due to variable beam patterns, the beam patterns may be equalized (e.g., using a filter with a non-flat frequency response) during playback at operation 211. The equalization may need to take into account the room acoustics since a large fraction of the acoustic energy can be reflected from room boundaries (e.g., walls) before the sound reaches the listener.

Figure 10:
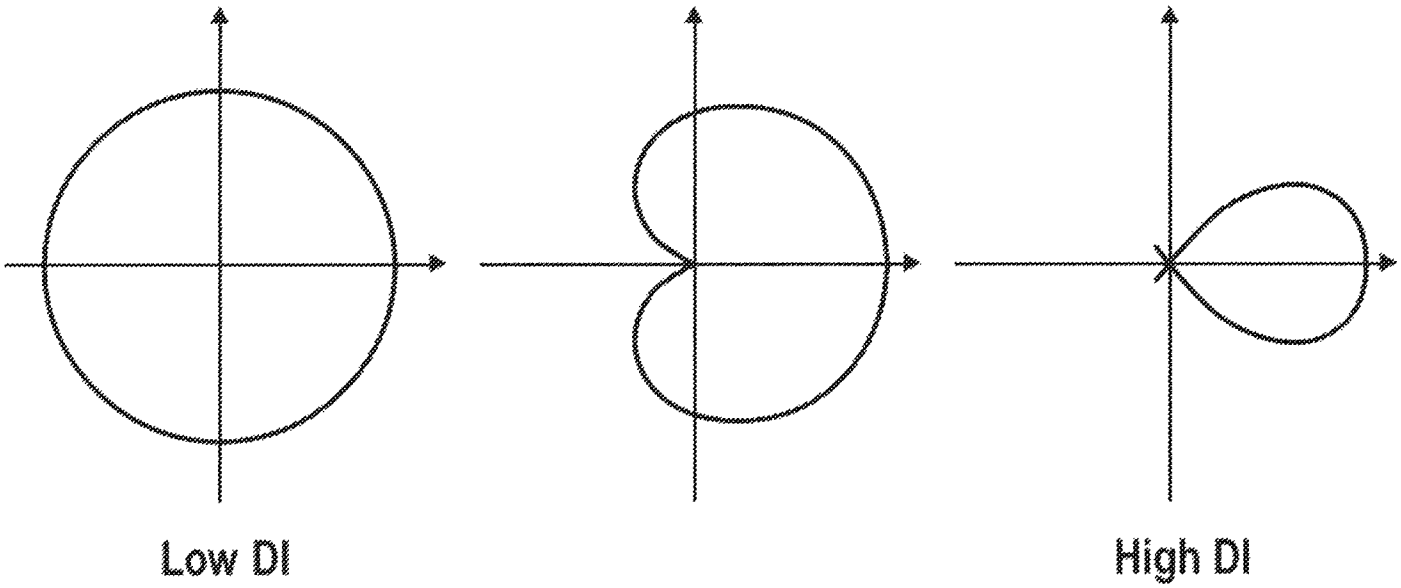
FIG. 10 shows several two-dimensional beam patterns that may be used to focus sound energy in certain directions according to one embodiment.

There may be several ways to focus sound energy into certain directions. The spatial distribution of the sound energy is commonly described by a three dimensional beam pattern that shows the energy level distribution on a sphere centered at a transducer. For example, FIG. 10 shows several two-dimensional beam patterns that may be used.

Figure 11:
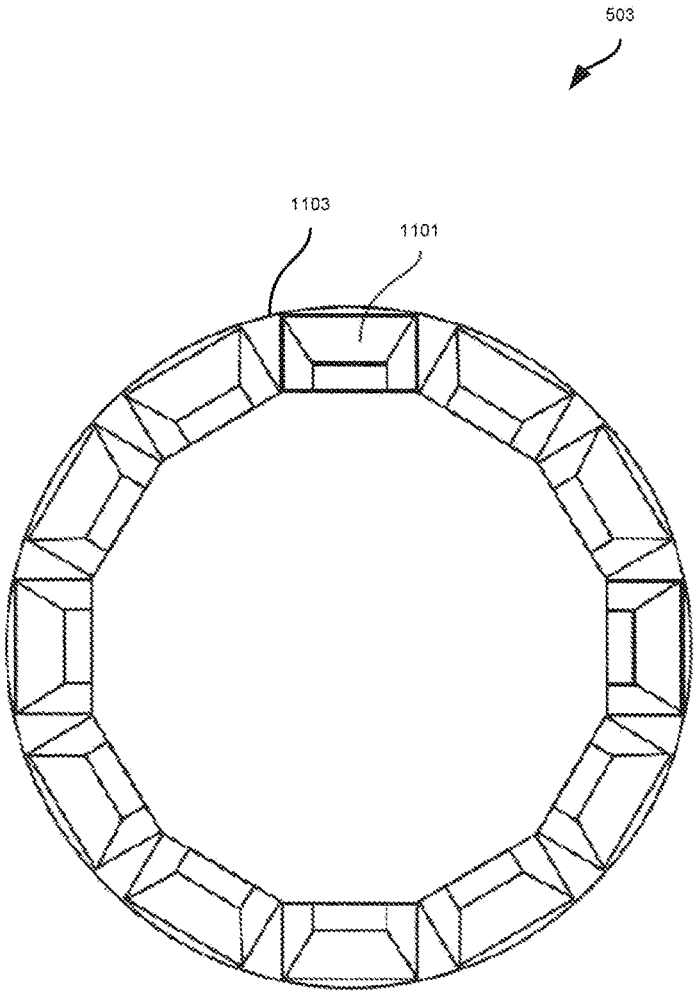
FIG. 11 shows an overhead, cutaway view of a loudspeaker array according to one embodiment.

FIG. 11 shows an overhead, cutaway view of a loudspeaker array 503 according to one embodiment. As shown in FIG. 11, the transducers 1101 in the loudspeaker array 503 encircle the cabinet 1103 such that transducers 1101 cover the curved face of the cabinet 1103. The transducers 1101 may be any combination of full-range drivers, mid-range drivers, subwoofers, woofers, and tweeters. Each of the transducers 1101 may use a lightweight diaphragm, or cone, connected to a rigid basket, or frame, via a flexible suspension that constrains a coil of wire (e.g., a voice coil) to move axially through a cylindrical magnetic gap. When an electrical audio signal is applied to the voice coil, a magnetic field is created by the electric current in the voice coil, making it a variable electromagnet. The coil and the transducers' 1101 magnetic system interact, generating a mechanical force that causes the coil (and thus, the attached cone) to move back and forth, thereby reproducing sound under the control of the applied electrical audio signal coming from an audio source. Although electromagnetic dynamic loudspeaker drivers are described for use as the transducers 1101, those skilled in the art will recognize that other types of loudspeaker drivers, such as piezoelectric, planar electromagnetic and electrostatic drivers are possible.

Each transducer 1101 may be individually and separately driven to produce sound in response to separate and discrete audio signals received from an audio source (e.g., an audio playback system). By allowing the transducers 1101 in the loudspeaker array 503 to be individually and separately driven according to different parameters and settings (including delays and energy levels), the loudspeaker array 503 may produce numerous directivity/beam patterns that accurately represent each channel or audio object of a piece of sound program content output. For example, in one embodiment, the loudspeaker array 503 may produce one or more of the directivity patterns shown in FIG. 10.

Figure 12:
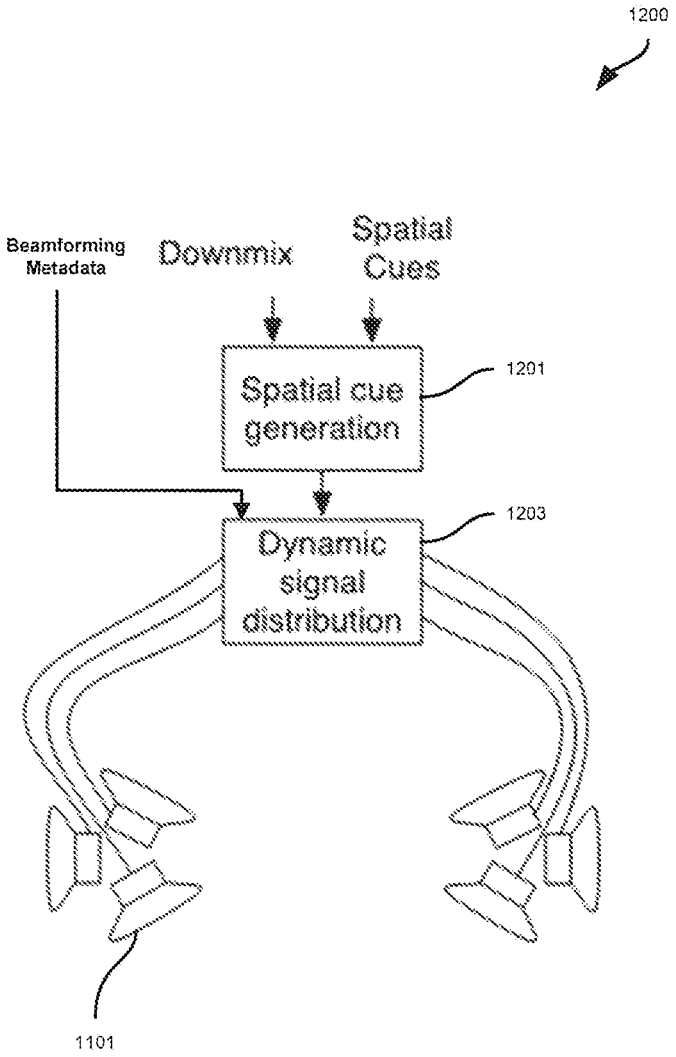
FIG. 12 shows an audio playback system with independent transducers that radiate into different directions according to one embodiment.

Depending on the design, sound transducers 1101 have more or less directivity. The directivity is high if sound is mostly radiated into one direction. Commonly the directivity is frequency dependent and is higher for high frequencies due to the smaller ratio of wavelength to transducer size. FIG. 12 shows an audio playback system 1200 with independent transducers 1101 that radiate into different directions. With this system 1200, the generated spatial image can be rendered by appropriate distribution of audio signal portions, corresponding to time-frequency tiles, to the transducers 1101 that generate the desired image in the same ways as described above. In this embodiment, the spatial cue generation unit 1201, which is fed spatial cues from the received bitstream, may generate signals that are distributed to transducers 1101 by the dynamic signal distribution unit 1203.

Figure 13:
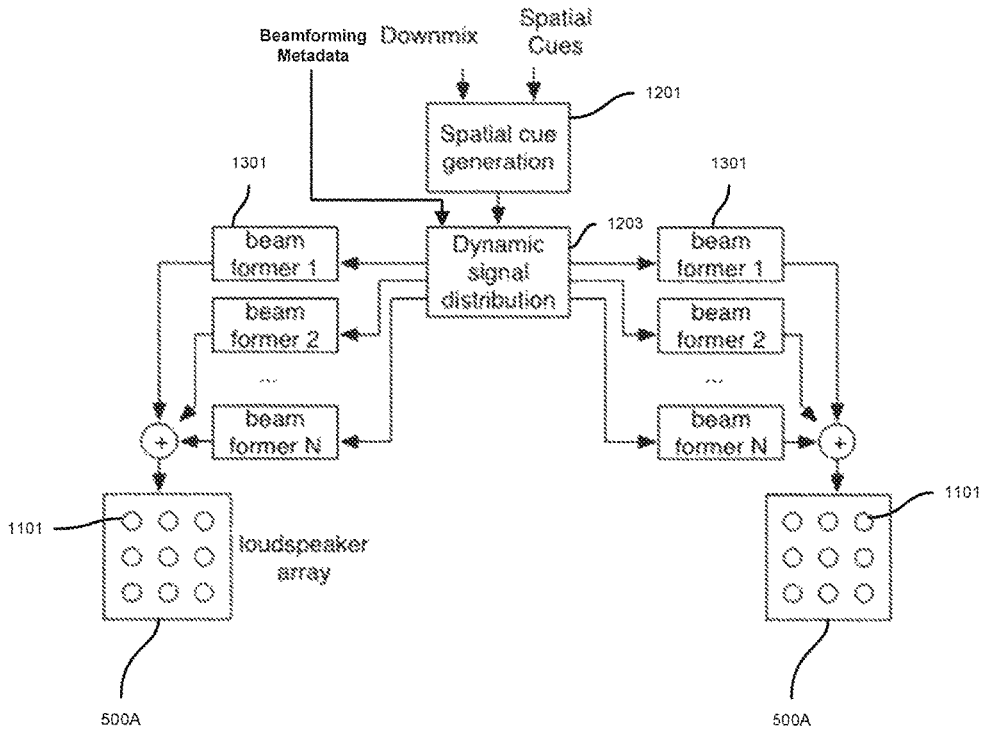
FIG. 13 shows an audio playback system with loudspeaker arrays (composed of a plurality of transducers) with a number of fixed beam formers according to one embodiment.

FIG. 13 shows a similar system 1300 as FIG. 12 but the individual transducers 1101 are replaced by loudspeaker arrays 500 (composed of a plurality of transducers 1101) with a number of fixed beam formers 1301. Depending on the size of the array 1100, the directivity and flexibility of generated beams may be much improved in this system 1300 as opposed to the individual transducers 1101 of FIG. 12. The spatial rendering process involving the beams is done in the same way as before by dynamic distribution of the audio signal components to the different static beams using the spatial cue generation unit 1201 and the dynamic signal distribution unit 1203. In one embodiment, beamforming metadata from the received bitstream may be fed to the beamformers 1301 and/or the dynamic signal distribution unit 1203 for generation of beams. As described above, the beamforming metadata may assist in the proper and/or more robust imaging of audio objects. In other embodiments, beams may be generated by the system 1300 solely based on the spatial cues from the bitstream.

Figure 14:
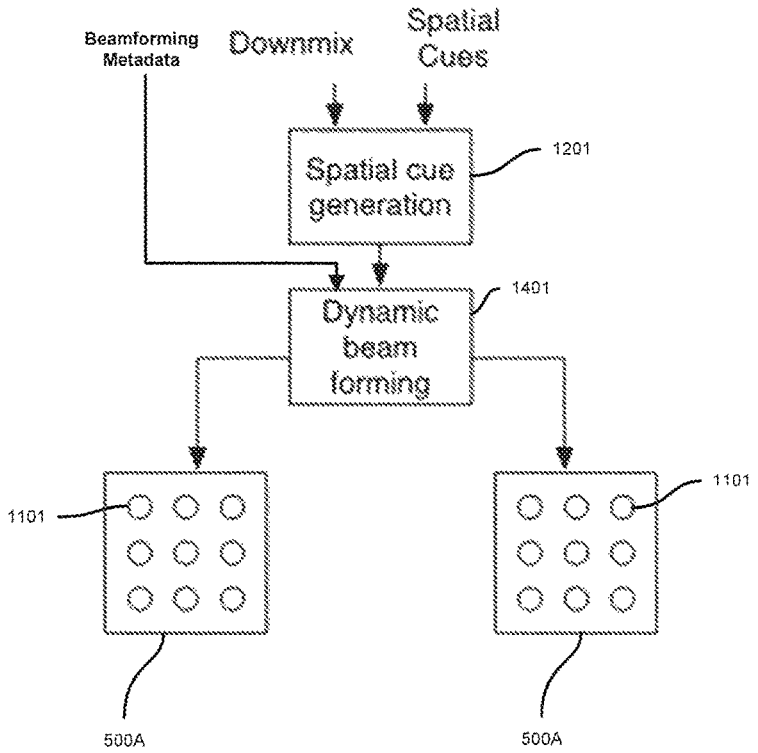
FIG. 14 shows an audio playback system with a dynamic beam former according to one embodiment.

FIG. 14 shows an audio playback system 1400 with a dynamic beam former 1401 instead of the static beam formers shown above. In this system 1400, the beams are dynamically steered to generate the desired spatial image. In the generic case, each time-frequency tile 401 would have an associated independent dynamic beam former 1401. In one embodiment, beamforming metadata from the received bitstream may be fed to the dynamic beam former 1401 for generation of beams. As described above, the beamforming metadata may assist in the proper and/or more robust imaging of audio objects.

As described above, an enhanced encoding system 100 and method 200 is described and shown that takes advantage of variable beam patterns of loudspeaker units. The system 100 and method 200 may be applicable to parametric spatial audio coding schemes, such as MPEG-Surround and SAOC. Further, the systems and methods described herein enable 3D audio reproduction at low bit rates with a small number of loudspeaker units. In addition to the traditional auditory spatial parameters, metadata is assigned to time-frequency tiles to describe acoustic and geometric object properties that facilitate the production of 3D audio beam patterns.

As explained above, an embodiment of the invention may be an article of manufacture in which a machine-readable medium (such as microelectronic memory) has stored thereon instructions which program one or more data processing components (generically referred to here as a "processor") to perform the operations described above. In other embodiments, some of these operations might be performed by specific hardware components that contain hardwired logic (e.g., dedicated digital filter blocks and state machines). Those operations might alternatively be performed by any combination of programmed data processing components and fixed hardwired circuit components.

While certain embodiments have been described and shown in the accompanying drawings, it is to be understood that such embodiments are merely illustrative of and not restrictive on the broad invention, and that the invention is not limited to the specific constructions and arrangements shown and described, since various other modifications may occur to those of ordinary skill in the art. The description is thus to be regarded as illustrative instead of limiting.

What is claimed is:

1. A method for rendering an audio signal representing a piece of sound program content, comprising:

generating beamforming metadata for the audio signal, wherein the beamforming metadata describes diffuseness characteristics of the piece of sound program content;

associating the beamforming metadata with the piece of the sound program content or a component of the piece of sound program content; and directing an audio playback system to playback the audio signal by driving loudspeaker units to produce one or more beam patterns that represent the piece of sound program content, the beam patterns pointing away from a listener if the piece of sound program content has high diffuseness and pointing toward the listener if the piece of sound program content has low diffuseness.

2. The method of claim 1, further comprising:

generating a set of spatial parameters for the audio signal, wherein the spatial parameters describe auditory spatial cues for the audio signal; and generating a bitstream based on 1) the audio signal, 2) the set of spatial parameters, and 3) the beamforming metadata.

3. The method of claim 2, wherein the spatial cues include one or more of inter-channel level differences (ILD), time differences (ITD), and correlation (IC) differences.

4. The method of claim 1, wherein the beamforming metadata describes three-dimensional sound characteristics for time-frequency segments of a downmix signal.

5. The method of claim 1, wherein the beamforming metadata is associated with an audio object, one or more audio channels, or a scene of the piece of sound program content represented by the audio signal.

6. The method of claim 5, wherein the beamforming metadata further includes one or more of 1) a three-dimensional location of the piece of sound program content or a component of the piece of sound program content, 2) a width of the piece of sound program content or a component of the piece of sound program content, 3) ambience characteristics of the piece of sound program content or a component of the piece of sound program content, 4) a direct-to-reverberant sound ratio of the piece of sound program content or a component of the piece of sound program content, and 5) room acoustic parameters describing characteristics of a virtual room in which the audio signal is simulated to be played back within by the audio playback system, wherein the virtual room is simulated through the generation of the one or more beam patterns.

7. A method for rendering a piece of sound program content, comprising:

receiving, by an audio playback system, a bitstream containing an audio signal representing the piece of sound program content;

extracting beamforming metadata from the bitstream associated with the piece of the sound program content or a component of the piece of sound program content, wherein the beamforming metadata describes diffuseness characteristics of the piece of sound program content;

producing a signal based on the audio signal and based on the beamforming metadata; and driving one or more loudspeaker units with the produced signal to produce one or more beam patterns that represent the piece of sound program content, the beam patterns pointing away from a listener if the piece of sound program content has high diffuseness and pointing toward the listener if the piece of sound program content has low diffuseness.

8. The method of claim 7, further comprising:

extracting one or more spatial parameters from the bitstream, wherein the spatial parameters describe auditory spatial cues for the piece of sound program content represented by the audio signal, wherein the loudspeaker units are driven to produce the one or more beam patterns representing the piece of sound program content further based on the one or more spatial parameters.

9. The method of claim 7, wherein the loudspeaker units are speaker arrays with multiple transducers, the multiple transducers in each of the speaker arrays being housed in a single cabinet.

10. The method of claim 8, wherein the spatial cues include one or more of inter-channel level differences (ILD), time differences (ITD), and correlation (IC) differences.

11. The method of claim 7, wherein the beamforming metadata describes three-dimensional sound characteristics for the time-frequency segments of a downmix signal.

12. The method of claim 7, wherein the beamforming metadata is associated with an audio object, one or more audio channels, or a scene of the piece of sound program content represented by the audio signal.

13. The method of claim 12, wherein the beamforming metadata further includes one or more of 1) a three-dimensional location of the piece of sound program content or a component of the piece of sound program content, 2) a width of the piece of sound program content or a component of the piece of sound program content, 3) ambience characteristics of the piece of sound program content or a component of the piece of sound program content, 4) a direct-to-reverberant sound ratio of the piece of sound program content or a component of the piece of sound program content, and 5) room acoustic parameters describing characteristics of a virtual room which the piece of sound program content is simulated to be played back by the one or more loudspeaker units, wherein the virtual room is simulated through the generation of the one or more beam patterns.

14. A computer system for rendering a piece of sound program content, comprising:

a beamforming metadata calculator to generate beamforming metadata for the piece of sound program content, wherein the beamforming metadata describes diffuseness characteristics of the piece of sound program content;

a bitstream generator to generate a bitstream based on 1) a downmix signal, 2) a set of spatial parameters, and 3) the beamforming metadata; and a dynamic signal distribution unit to distribute the bitstream to an audio playback device that plays back the piece of sound program content by driving loudspeaker units to produce one or more beam patterns that represent the piece of sound program content, the beam patterns pointing away from a listener if the piece of sound program content has high diffuseness and pointing toward the listener if the piece of sound program content has low diffuseness.

15. The computer system of claim 14, further comprising:

a spatial cue calculator to generate the set of spatial parameters for an audio signal, wherein the spatial parameters describe auditory spatial cues for the audio signal, wherein the spatial cues include one or more of inter-channel level differences (ILD), time differences (ITD), and correlation (IC) differences.

16. The computer system of claim 14, wherein the beamforming metadata describes three-dimensional sound characteristics for time-frequency segments of the downmix signal.

17. The computer system of claim 14, wherein the beamforming metadata is associated with an audio object, one or more audio channels, or a scene of the piece of sound program content represented by the downmix signal.

18. The computer system of claim 17, wherein the beamforming metadata further includes one or more of 1) a three-dimensional location of the piece of sound program content or a component of the piece of sound program content, 2) a width of the piece of sound program content or a component of the piece of sound program content, 3) ambience characteristics of the piece of sound program content or a component of the piece of sound program content, 4) a direct-to-reverberant sound ratio of the piece of sound program content or a component of the piece of sound program content, and 5) room acoustic parameters describing characteristics of a virtual room in which the downmix signal is simulated to be played back within by the audio playback system, wherein the virtual room is simulated through the generation of the one or more beam patterns.

19. An article of manufacture for rendering a piece of sound program content, comprising:

a non-transitory machine-readable storage medium that stores instructions which, when executed by a processor in a computing device, extract beamforming metadata from a bitstream associated with components of the piece of sound program content, wherein the beamforming metadata describes diffuseness characteristics of the piece of sound program content;

produce a signal based on an audio signal and based on the beamforming metadata; and drive the one or more loudspeaker units to produce one or more beam patterns that represent the piece of sound program content, the beam patterns pointing away from a listener if the piece of sound program content has high diffuseness and pointing toward the listener if the piece of sound program content has low diffuseness.

20. The article of manufacture of claim 19, wherein the non-transitory machine-readable storage medium stores further instruction which when executed by the processor:

extract one or more spatial parameters from the bitstream, wherein the spatial parameters describe auditory spatial cues for the piece of sound program content represented by the audio signal, wherein the loudspeaker units are driven to produce the one or more beam patterns representing the piece of sound program content further based on the one or more spatial parameters.

21. The article of manufacture of claim 19, wherein the loudspeaker units are speaker arrays with multiple transducers, the multiple transducers in each of the speaker arrays being housed in a single cabinet.

22. The article of manufacture of claim 20, wherein the beamforming metadata describes three-dimensional sound characteristics for time-frequency segments of a downmix signal.

23. The article of manufacture of claim 19, wherein the beamforming metadata is associated with an audio object, one or more audio channels, or a scene of the piece of sound program content represented by the audio signal.

24. The article of manufacture of claim 23, wherein the beamforming metadata further includes one or more of 1) a three-dimensional location of the piece of sound program content or a component of the piece of sound program content, 2) a width of the piece of sound program content or a component of the piece of sound program content, 3) ambience characteristics of the piece of sound program content or a component of the piece of sound program content, 4) a direct-to-reverberant sound ratio of the piece of sound program content or a component of the piece of sound program content, and 5) room acoustic parameters describing characteristics of a virtual room in which the audio signal is simulated to be played back within by the audio playback system, wherein the virtual room is simulated through the generation of the one or more beam patterns.

* * * * *